US005587101A

United States Patent [19]

Hattanda et al.

[11] Patent Number: 5,587,101

[45] Date of Patent: Dec. 24, 1996

[54] GAS INJECTION NOZZLE FOR POURING LIQUID METAL

[75] Inventors: Hirokatsu Hattanda; Mitsukazu Ogiso; Yasuta Koike; Kazuhiro Takagi, all of Tokyo, Japan

[73] Assignee: Tokyo Yogyo Kabushiki Kaisha, Tokyo, Japan

[21] Appl. No.: 536,438

[22] Filed: Sep. 29, 1995

[51] Int. Cl.[6] ..... B22D 41/58

[52] U.S. Cl. ..... 222/603; 266/220

[58] Field of Search ..... 222/603; 266/220, 266/217, 236

[56] References Cited

U.S. PATENT DOCUMENTS

| | | | |
|---|---|---|---|
| 4,360,190 | 11/1982 | Ato | 266/220 |
| 4,756,452 | 7/1988 | Tsukomoto et al. | 222/603 |
| 5,137,189 | 8/1992 | Hall et al. | 222/603 |

*Primary Examiner*—Scott Kastler
*Attorney, Agent, or Firm*—Noland J. Cheung; Michael J. Kline; Carol I. Bordas

[57] ABSTRACT

The object of the present invention is to provide a gas injection nozzle which is used for pouring liquid metal and which is prevented from being blocked in the course of continuous casting. According to the present invention, a gas injection nozzle for pouring liquid metal is provided, wherein (a) the nozzle consists of a porous refractory, (b) the circumference of the nozzle is surrounded by an iron shell which has a gas injection pipe, a band-like space (referred to as a gas pool hereinafter) which extends along the circumference of the nozzle perpendicular to an axis of the nozzle between the porous refractory and the iron shell, and (c) the gas pool is formed as a wavy, band-like space along at least one portion of the circumference of the nozzle.

3 Claims, 4 Drawing Sheets

GAS INJECTION NOZZLE FOR POURING LIQUID METAL

FIELD OF THE INVENTION

The present invention relates to a gas injection nozzle connected to an immersion nozzle used for pouring liquid metal (e.g. liquid steel) from a tundish into a mold during continuous casting, an upper or lower nozzle connected to an air seal pipe or an open nozzle for continuous casting and the like.

BACKGROUND AND DESCRIPTION OF THE RELATED ART

It is well-known to use an immersion nozzle for pouring molten steel from a tundish into a mold in the continuous casting of steel. In the course of the continuous casting, alumina ($Al_2O_3$) contained in the liquid steel or produced by the oxidation of Aluminum (Al) contained in the liquid steel, can adhere to the inner surface of the nozzle and cause what is commonly called "nozzle blockage" in which the nozzle is blocked by alumina inclusions.

Thus, in order to prevent this nozzle blockage and thereby perform smooth casting, inert gas such as Argon (Ar) gas, Nitrogen ($N_2$) gas or a similar inert gas is injected from an upper nozzle or a lower nozzle, which is connected to the immersion nozzle, such that the alumina inclusions on the inner wall of the nozzle hole can be removed. This method is presently applied to an upper or lower nozzle which is connected to an immersion nozzle, an air seal pipe or a similar device as shown in FIGS. 4 to 6.

FIG. 4 shows an example of the mounting construction in which an immersion nozzle is connected to a tundish. As shown in this figure, an upper nozzle 10 is inserted into the bottom of a tundish located over this construction. Slide plates 11, 12 are placed on the underside of the upper nozzle. Generally, the upper slide plate 11 is fixed and the lower slide plate 12 is slidably attached so as to open/close a lower nozzle 20 connected to the lower slide plate 12. An immersion nozzle 30 is connected to the lower nozzle 20.

FIG. 5 shows an example of the mounting construction of an air seal pipe 40, which is used for pouring liquid steel from a ladle into a tundish. The ladle is provided over this structure and the tundish is located below it.

An upper nozzle 10 is mounted on the bottom of the ladle. Slide plates 11, 12 are placed on the downside of this upper nozzle 10 in order to regulate the flow rate of liquid steel being poured into the tundish. Generally, the upper slide plate 11 is fixed and the lower slide plate 12 is slidably attached so as to regulate the flow rate of molten steel. A lower nozzle 20 is provided below the lower slide plate 12 and an air seal pipe 40 is mounted on the underside of the lower nozzle 20.

FIG. 6 shows an example of the mounting construction in which an open nozzle 50 is mounted on the bottom of a tundish. Slide plates 11, 12 are attached to the underside of an upper nozzle 10. The open nozzle 50 is placed on the underside of the lower slide plate 12.

In each of the above-mentioned examples, inert gas is introduced from a gas injection pipe 5 into the upper nozzle 10 in order to prevent the blockage of this nozzle. The blockage of the lower nozzle is also prevented in the same manner as shown in the upper nozzle 10.

FIG. 7 is a detailed sectional view of an upper nozzle 10 of the prior art. This gas injection nozzle is composed of a permeable porous refractory 4 and has a nozzle hole 3 through which liquid metal passes. Generally, the whole circumference of this nozzle is surrounded by an iron shell 2 and is formed such that the gas introduced through a gas injection pipe 5 can be blown into the nozzle hole 3.

Generally, a gas pool 1*a*, which is resistant to heat, is provided in the middle portion of the porous refractory 4. This gas pool 1*a* is formed as a space between a portion of the circumference of the porous refractory 4 and the corresponding portion of an iron shell 2. Due to the existence of this gas pool 1*a*, the gas supplied through the gas supplying pipe can penetrate into the porous refractory 4 and leak into the nozzle hole 3, which makes it possible to prevent such inclusions as alumina from depositing on the inner surface of the nozzle hole 3.

As shown in FIG. 7., the nozzle hole 3 is formed as a cylindrical space between the porous refractory 4 and the iron shell 2. When liquid metal has passed through the nozzle hole 3, the temperature of the nozzle hole 3 is high at its upper portion and low at its lower portion. Thus, thermal stress is produced in the axial direction of the porous refractory 4. As shown in FIG. 7, this thermal stress can lead to a crack 6 which occurs in a direction perpendicular to the axial direction of the porous refractory 4 in the upper side of the gas pool 1*a*.

FIG. 8 is a detailed sectional view of a lower nozzle 20 of the prior art. Similarly, as in the case of the upper nozzle mentioned above, the thermal stress produced in the axial direction of the porous refractory 4 can lead to a crack 6, which occurs in a direction perpendicular to this axial direction.

SUMMARY OF THE INVENTION

When the cracks described above are produced in the early stages of continuous casting, a large amount of gas locally enters into the nozzle hole through these cracks. This hinders the gas penetration through the whole body of the nozzle and consequently, causes a frequent occurrence of the blockage of this nozzle.

Therefore, the object of the present invention is to provide a gas injection nozzle for continuous casting, for example, which can prevent the occurrence of the cracks. The prevention of these cracks, which are produced during continuous casting and which occur in a direction perpendicular to the axial direction of a porous refractory, can be accomplished by the present invention such that the blockage of this nozzle can be avoided even during long-duration casting.

Studies for finding the causes of the above-mentioned cracks have shown that the cracks in the porous refractory are produced because the gas pool is formed as a straight, band-like space which extends circumferentially in a direction perpendicular to the axial direction of the nozzle.

Therefore, the cracks produced in a direction perpendicular to the axial direction of the nozzle can be prevented by forming the gas pool into a wavy or corrugated, band-like space, which are shaped in parallel ridges and grooves for purposes of rigidity, in order to avoid the occurrence of the cracks in a direction perpendicular to the axial direction of the nozzle. Based on this knowledge, the present invention is described as follows:

(1) According to the first aspect of the present invention, a gas injection nozzle for pouring liquid metal is provided, wherein (a) the nozzle consists of a porous refractory;

(b) the circumference of the nozzle is surrounded by a iron shell which has a gas injection pipe, a band-like space (referred to as a gas pool hereinafter) which extends along the circumference of the nozzle perpendicular to the axis of the nozzle and is provided between the porous refractory and the iron shell; and (c) the gas pool is formed as a wavy, band-like space along at least one portion of the circumference of the nozzle.

(2) According to the second aspect of the present invention, a gas injection nozzle for pouring liquid metal is provided, wherein the width (W) of the wavy gas pool is less than the depth (H) of its groove-like portion (see FIG. 3).

(3) According to the third aspect of the present invention, a gas injection nozzle for pouring liquid metal is provided, wherein:

the width (W) of the wavy gas pool is less than the depth (H) of its groove-like portion;

the wavy, band-like shape of the gas pool is sinusoidal; and the circumference of the nozzle has a shape of a sinusoidal wave of 1 cycle or more.

DETAILED DESCRIPTION OF INVENTION

As described hereinbefore, for a known gas injection nozzle for continuous casting, a gas pool is formed as a straight, band-like space between a portion of the circumference of a porous refractory and the corresponding portion of an iron shell. This gas pool extends along the circumference of the nozzle perpendicular to the axis of the nozzle.

For a gas injection nozzle according to the present invention, a gas pool is formed as a wavy, band-like space which extends along the circumference of the nozzle perpendicular to its axis. Similarly, for an upper or lower nozzle, a gas pool is formed as a wavy, band-like space. This gas pool of a wavy, band-like shape extends along at least one portion of the circumference of the nozzle, and preferably extends along the entire circumference of the nozzle.

Since the gas pool is formed as a wavy, band-like space, the cracks caused by thermal stress are apt to occur along the wavy form of the gas pool and, as a result, cannot propagate in a direction perpendicular to the nozzle axis. Thus, such cracks are produced only locally and the blockage of the nozzle can be prevented because a large amount of gas does not rapidly penetrate into the nozzle hole through the crack.

The gas pool can be in the form of any smooth wavy shape. Preferably, the width (W) of the wavy gas pool is less than the depth (H) of its groove-like portion (see FIG. 3). Under these conditions, a crack produced in a direction perpendicular to the nozzle axis encounters the nearest ridge or groove in the course of its propagation and, thus, stops at this ridge or groove.

Furthermore, the design and production of a porous refractory can be made easier by employing a sinusoidal shape for the wavy, band-like gas pool. When this sinusoidal shape is used, the gas pool preferably extends along at least one portion of the circumference of the nozzle, and more preferably extends along the entire circumference of the nozzle. Moreover, it is preferable that the gas pool has a sinusoidal shape of 1 cycle or more along the circumference of the nozzle.

Figure 1:
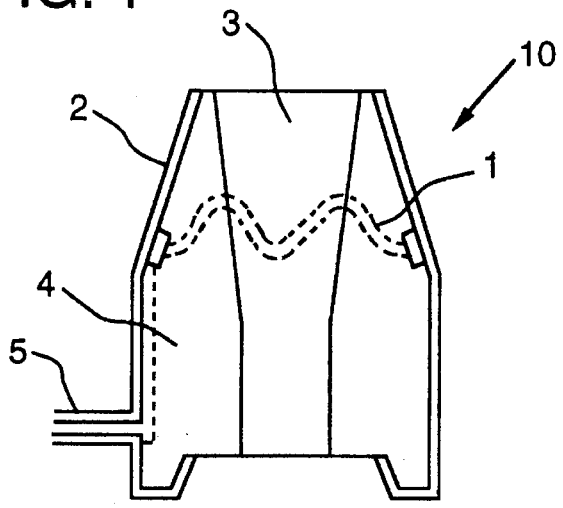
FIG. 1 is a sectional view showing a structure of an upper nozzle according to the present invention.

FIG. 1 shows a gas injection nozzle according to the first embodiment of the present invention, in which a wavy, band-like gas pool 1 located in the middle portion of the upper nozzle 10 extends in a direction perpendicular to the nozzle axis and has a wavy, band-like shape in the direction of the nozzle axis.

Figure 2:
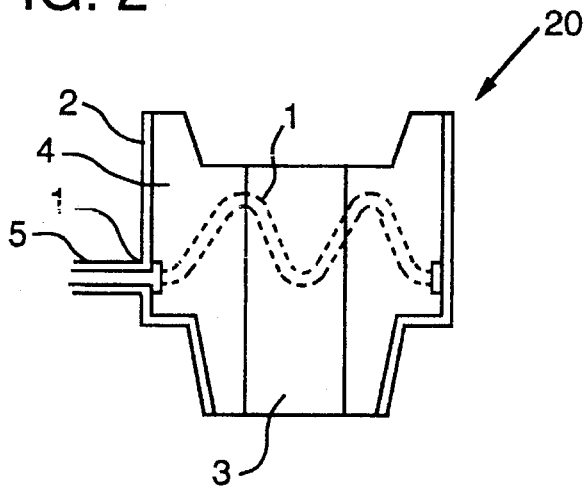
FIG. 2 is a sectional view showing a structure of a lower nozzle according to the present invention.

FIG. 2 shows the lower nozzle 20 which is provided with a wavy, band-like gas pool 1 similar to the wavy, band-like gas pool 1 of the upper nozzle 10 shown in FIG. 1.

Figure 3:
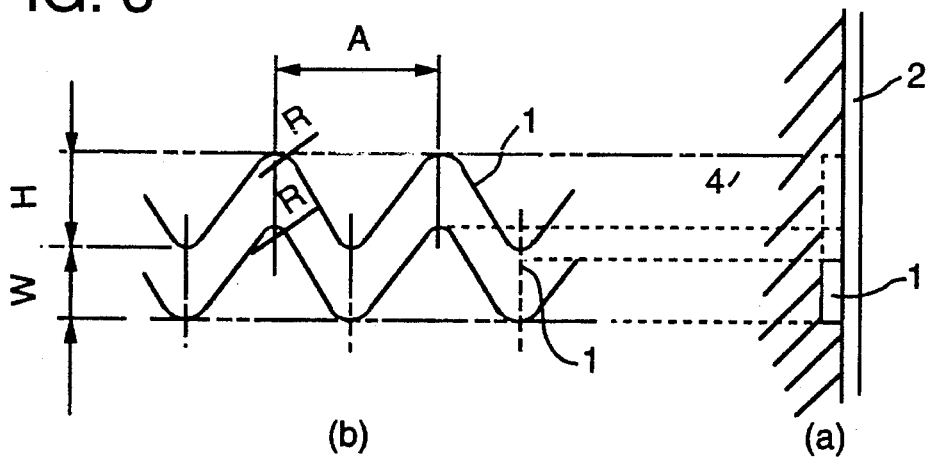
FIG. 3 shows longitudinal sectional and expansion views of a gas pool according to the present invention.
Figure 4:
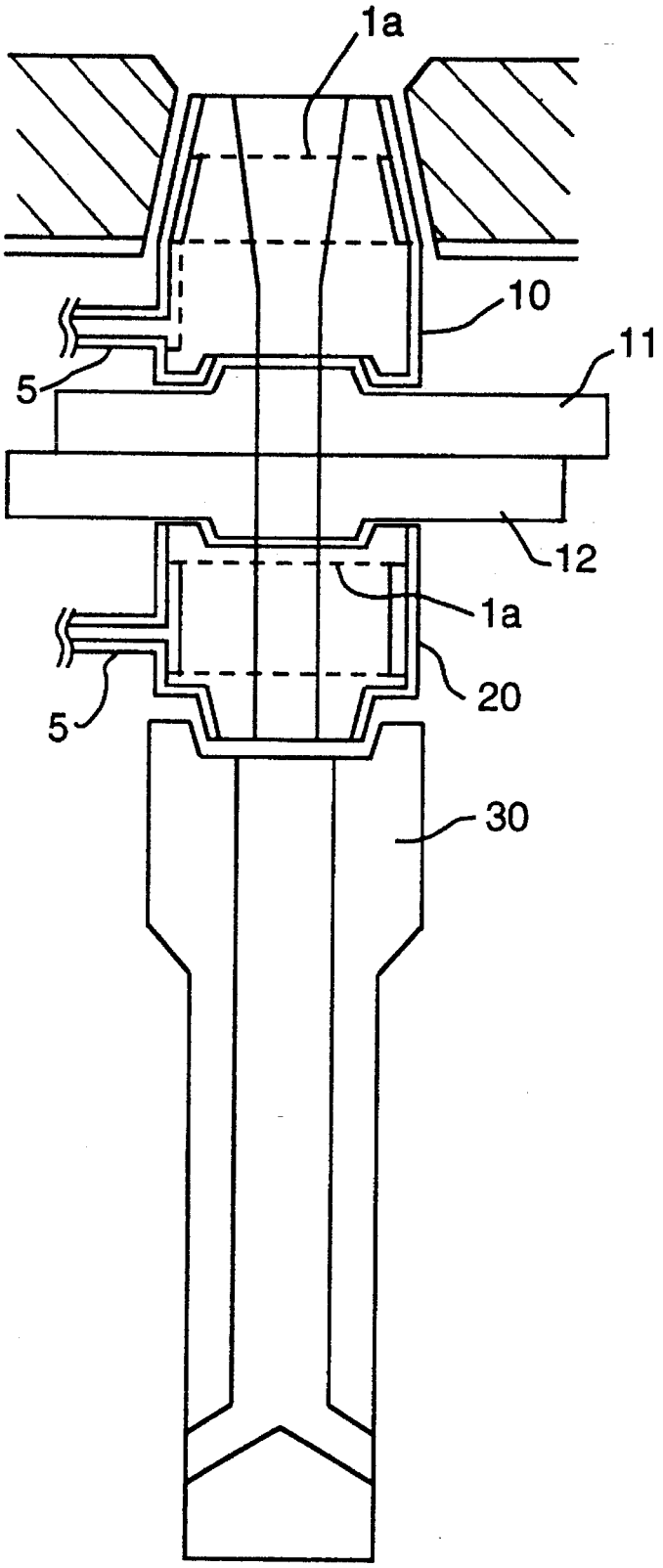
FIG. 4 is a sectional view showing an interconnection of an upper nozzle, a lower nozzle and a tundish which is adopted for continuous casting.

FIG. 3 shows the details of the wavy, band-like gas pool 1 of the lower nozzle 20 shown in FIG. 2.

In FIG. 3, Section (a), the shape of the gas pool 1, which is in its vertical section, is shown.

In addition, Section (b) of FIG. 3 shows an illustration of the gas pool 1, which is shown in one plane. For preventing the concentration of thermal stress, it is desirable that this wavy, band-like gas pool extends in a direction perpendicular to the nozzle axis and its shape draws a curve as smoothly as possible.

Thus, in order to prevent the occurrence of cracks induced by the concentration of thermal stress, it is desirable that each of the curves of the ridges and grooves of the wavy, band-like shape has the same radius (R). Preferably, this wavy shape has at least one cycle along the circumference of the porous refractory.

As shown in FIG. 3, it is desirable that the width (W) of the wavy, band-like gas pool 1 is less than the depth (H) of its groove-like portion as shown in Section (b) of FIG. 3. When W is greater than H, a crack produced in the gas pool propagates around the circumference in a direction perpendicular to the nozzle axis. In contrast, when W is less than H, such a crack must encounter the nearest groove or ridge of the wavy, band-like shape in the course of its propagation and stop at such a groove or ridge, which then results in preventing the propagation of the crack around the circumference.

Also, as shown in FIG. 3, it is preferable that the wavy, band-like shape of the gas pool draws a smooth curve as described hereinbefore. It is more preferable that the curve of this wavy, band-like shape is sinusoidal. A sinusoidal shaped gas pool has a regularity because the shape can be reproduced by giving an amplitude and one cycle length.

This regularity facilitates the design and manufacture of the nozzle. The gas pool of the upper nozzle can also take a wavy, band-like shape similar to the upper nozzle.

Thus, it is possible that the tensile stress which can be produced in the axial direction of the nozzle during the early stages or the succeeding stages of pouring is prevented from causing a crack to occur in a direction perpendicular to the nozzle axis.

In one embodiment of the present invention, a performance comparison test was conducted between: 1) an immersion nozzle connected to an upper nozzle and an immersion nozzle connected to a lower nozzle (both the upper and lower nozzle containing a gas pool having a 6-cycle sinusoidal shape along its circumference); and 2) an immersion nozzle connected to an upper nozzle and a lower nozzle, in which both the upper and lower nozzle contain a conventional gas pool having a simple, band-like shape.

In this comparison test, the behavior of each of these immersion nozzles in the course of pouring was simulated by measuring the variations of their back pressures (mmAq) while heating each of their nozzle holes with a burner and introducing Ar gas into the nozzle holes at a flow rate of 5 liters/min.

Furthermore, the porous refractory material used in this test comprised a high alumina material ($Al_2O_3$) content of not less than 80%, which had a porosity of 18 to 22%, a bulk specific gravity of 2.9 to 3.0 g/cm$^3$, a compression strength of 15 to 60 MPa/cm$^2$, and an average pore diameter of 5 to 60 μm.

The results of the test are listed in Table 1. As shown in this table, the back pressure of the conventional immersion nozzle began to decrease in the vicinity of 900° C. In contrast, the immersion nozzle connected to a gas injection nozzle of the present invention did not exhibit such a phenomenon and no crack was developed in its porous refractory.

Moreover, an immersion nozzle connected to a gas injection nozzle of the present invention was actually applied to the continuous casting of steel and an investigation of its nozzle blockage condition during this casting was performed. The results of this investigation showed that the nozzle was almost completely clear of any blockage caused by alumina inclusions.

Figure 5:
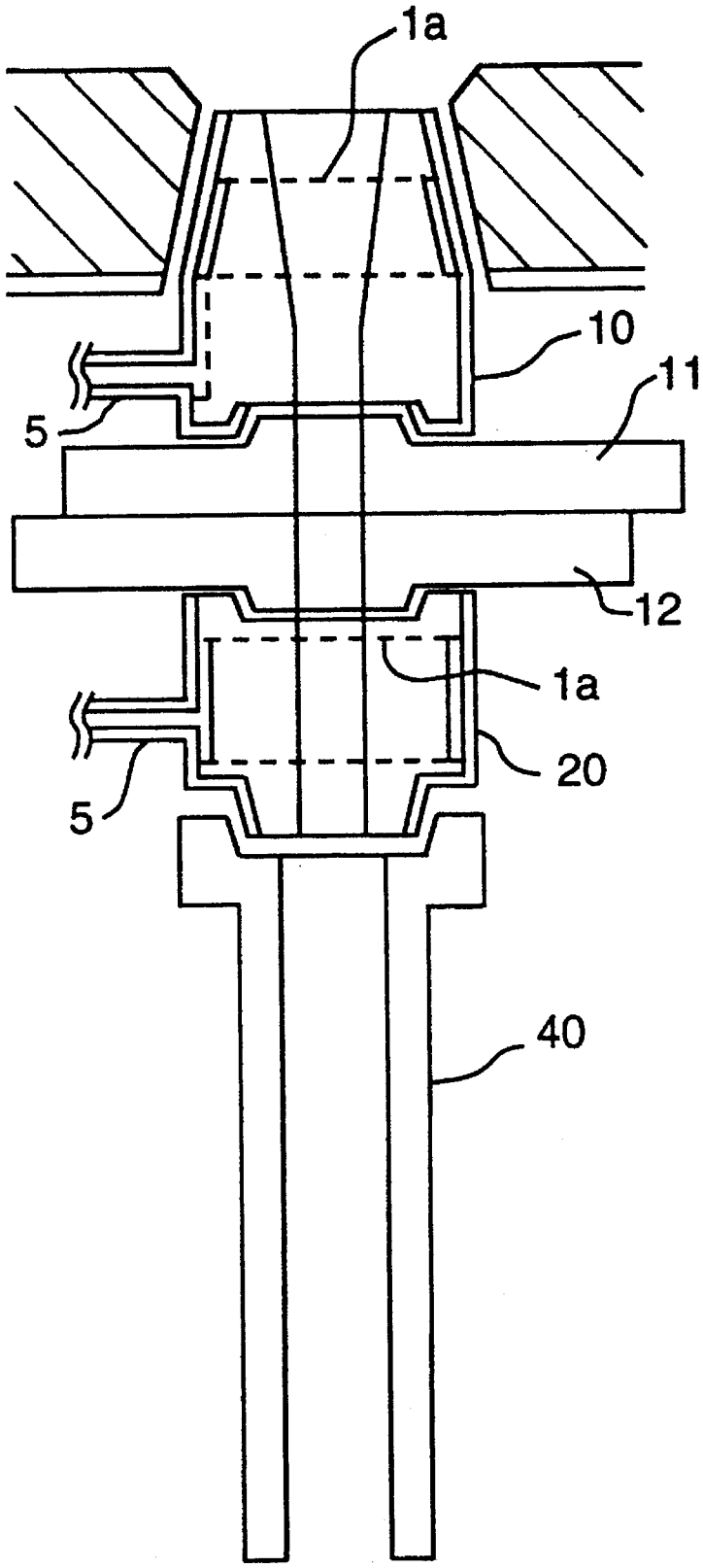
FIG. 5 is a sectional view showing a mounting construction of an air seal pipe for pouring liquid metal from a ladle into a tundish.
Figure 6:
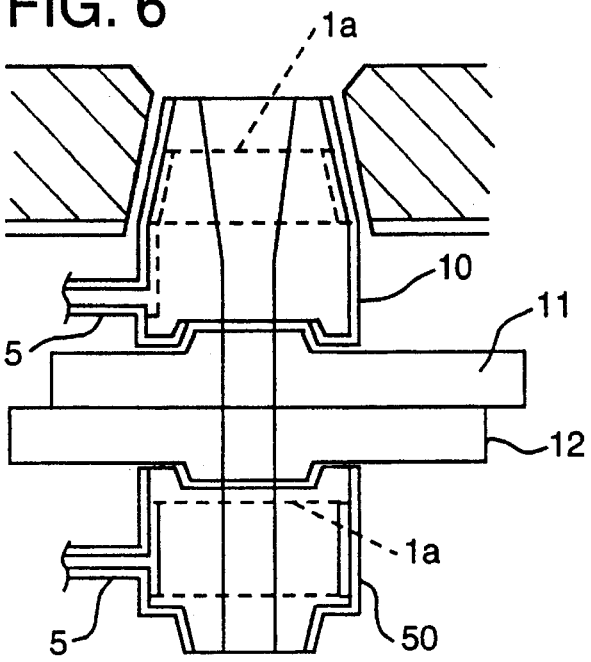
FIG. 6 is a sectional view showing a structure of a known open nozzle used for continuous casting.
Figure 7:
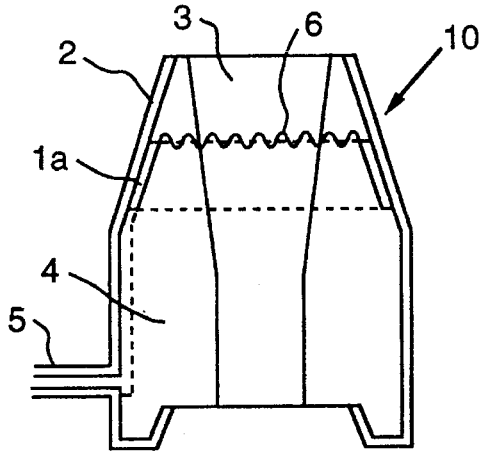
FIG. 7 is a schematic diagram showing a structure of a known upper nozzle and the cracks which are produced in a gas pool formed as a straight-band-like space extending in a direction perpendicular to the axis of the upper nozzle.
Figure 8:
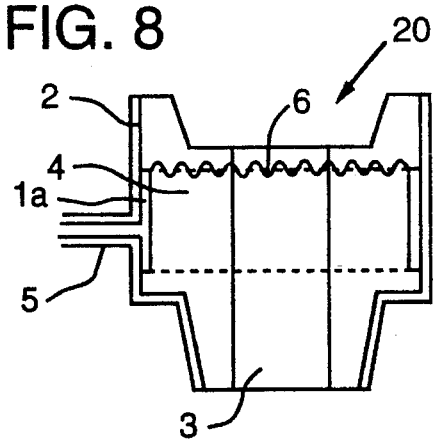
FIG. 8 is a schematic diagram showing the structure of a known lower nozzle and the cracks which are produced perpendicularly to the axis of the lower nozzle.

In this embodiment, as described hereinbefore, the present invention has been described mainly in connection with upper and lower nozzles of an immersion nozzle used for continuous casting. The application of the concept of the present invention, however, is not limited only to these nozzles. As shown in FIGS. 5 and 6, the present invention can also be applied to an air seal pipe and to an open nozzle.

As described above, for a gas injection nozzle according to the present invention, a gas pool is located between an iron shell and an inner porous refractory. The gas pool extends along the circumference of the nozzle in a direction perpendicular to the nozzle axis in a form such that a band-like gas pool corrugates in the direction of the nozzle axis. Therefore, the thermal stress produced in the axial direction of the nozzle which causes the occurrence of cracks in a direction perpendicular to the nozzle axis is easily prevented.

Thus, it is possible to prevent the accumulation of alumina inclusions or similar types of inclusions on the inner surface of the nozzle hole and, therefore, to perform gas injection of long-duration in the course of liquid metal casting. As a result, smooth and long-duration casting can be achieved. The present invention makes it possible to produce high-quality, continuous castings and other ingots and will provide great industrial benefits.

While we have illustrated and described several embodiments of our invention, it will be understood that these are by way of illustration only and that various changes and modifications may be contemplated in our invention and within the scope of the following claims.

TABLE 1

| Temperature (°C.)[1] | Present Invention[2] | Prior Art[2] |
|---|---|---|
| Room Temp. | 400 | 400 |
| 100 | 420 | 420 |
| 200 | 450 | 450 |
| 300 | 500 | 500 |
| 400 | 530 | 530 |
| 500 | 580 | 580 |
| 600 | 600 | 600 |
| 700 | 720 | 720 |
| 800 | 780 | 780 |
| 900 | 820 | 760 |
| 1000 | 890 | 670 |
| 1100 | 910 | 660 |
| 1200 | 950 | 550 |
| 1300 | 950 | 500 |

Notes
1: The temperature of the nozzle hole heated by a burner.
2: The back pressure (mmAq) measured when Ar gas was injected into the nozzle at the flow rate of 5 l/min.

We claim:

1. A gas injection nozzle for pouring liquid metal, wherein:

(a) said nozzle having a circumference consisting of a porous refractory, (b) said circumference of said nozzle is surrounded by an iron shell having a gas injection pipe nozzle through which gas is injected to form a gas pool; said gas pool extending perpendicularly along said circumference of said nozzle between said porous refractory and said iron shell; and (c) said gas pool having a wavy space along at least one portion of said circumference of said nozzle.

2. A gas injection nozzle according to claim 1, wherein a width (W) of said wavy space is less than a depth (H) of said wavy space.

3. A gas injection nozzle according to claim 1, wherein a width (W) of said wavy space is less than a depth (H) of said wavy space;

said wavy space of said gas pool is sinusoidal in shape; and said wavy space comprises at least one cycle of said sinusoidal shape.

* * * * *